US006065456A

United States Patent [19]

Miyoshi et al.

[11] Patent Number: 6,065,456

[45] Date of Patent: May 23, 2000

[54] EXHAUST GAS RE-CIRCULATING APPARATUS

[75] Inventors: Sotsuo Miyoshi; Hidetoshi Okada, both of Tokyo, Japan

[73] Assignee: Mitsubishi Denki Kabushiki Kaisha, Tokyo, Japan

[21] Appl. No.: 09/185,029

[22] Filed: Nov. 3, 1998

[30] Foreign Application Priority Data

Jun. 5, 1998 [JP] Japan ..... 10-158239

[51] Int. Cl.[7] ..... F02M 25/07

[52] U.S. Cl. ..... 123/568.2

[58] Field of Search ..... 123/568.2

[56] References Cited

U.S. PATENT DOCUMENTS

| | | | |
|---|---|---|---|
| 3,702,111 | 11/1972 | Weaving et al. | 123/568.2 |
| 4,156,414 | 5/1979 | Kawamura et al. | 123/568.2 |
| 4,192,265 | 3/1980 | Amano et al. | 123/568.2 |
| 4,276,865 | 7/1981 | Hamai | 123/568.2 |
| 4,278,063 | 7/1981 | Nakamura et al. | 123/568.2 |
| 5,115,790 | 5/1992 | Kawamura | 123/568.2 |
| 5,261,373 | 11/1993 | Ohsuga et al. | 123/568.2 |
| 5,746,189 | 5/1998 | Kuzuya et al. | 123/568.2 |

FOREIGN PATENT DOCUMENTS

| | | |
|---|---|---|
| 4-44462 | 4/1992 | Japan . |
| 9-273452 | 10/1997 | Japan . |

*Primary Examiner*—Willis R. Wolfe
*Attorney, Agent, or Firm*—Sughrue, Mion, Zinn, Macpeak & Seas, PLLC

[57] ABSTRACT

Exhaust gas re-circulating valves are provided in an exhaust gas re-circulating passage communicating with an exhaust system and an intake system of an engine provided with a plurality of cylinders such that the distance between the exhaust gas re-circulating valve and a corresponding cylinder is identical for all the cylinders.

3 Claims, 2 Drawing Sheets

EXHAUST GAS RE-CIRCULATING APPARATUS

BACKGROUND OF THE INVENTION

1. Field of the Invention

The present invention generally relates to an exhaust gas re-circulating (EGR) apparatus and, more particularly, to an exhaust gas re-circulating apparatus for returning a portion of exhaust gas in a multi-cylinder engine to a respective cylinder so as to reduce the volume of NOX in the exhaust gas.

2. Description of the Related Art

FIG. 3 is a schematic diagram showing the construction of a prior-art exhaust gas re-circulating apparatus disclosed in the Japanese Laid-Open Utility Model Application No. 4-44462. Referring to FIG. 3, the apparatus comprises an engine 1 provided with a plurality of cylinders, an intake manifold 1A for the engine 1, an exhaust manifold 1B for the engine 1, an intake pipe 2 for the intake manifold 1A, intake branch pipes 3, 4, 5 and 6 branching off of the intake pipe 2 and connected to respective intake ports of the cylinders of the engine 1, exhaust branch pipes 7, 8, 9 and 10 of the exhaust manifold 1A. The exhaust branch pipes 7, 8, 9 and 10 are connected to respective exhaust ports of the cylinders of the engine 1. An exhaust pipe 11 of the exhaust manifold 1B collects the exhaust gas from the exhaust branch pipes and guide the same to the outside.

The apparatus further comprises an exhaust gas re-circulating passage 12 branching off of the exhaust pipe 11 and returning a portion of the exhaust gas to a combustion chamber of the engine 1, branch pipes 13, 14, 15 and 16 branching off of the exhaust gas re-circulating passage 12 and connected to the intake branch pipes 3, 4, 5 and 6 of the intake manifold 1A so as to correspond to respective cylinders of the engine 1, and exhaust gas re-circulating valves (EGR valves) 17 provided at respective joints between the branch pipes 13, 14, 15 and 16 and the exhaust gas re-circulating passage 12. The exhaust gas re-circulating valves 17 of the branch pipes 13, 14, 15 and 16 are removed from respective joints with the intake branch pipes 3, 4, 5 and 6 by different distances.

An O2 sensor 18 is provided in each of the intake branch pipes 3, 4, 5 and 6 so as to measure the volume of intake air taken in by the respective cylinder of the engine 1. A temperature sensor 19 is provided in each of the intake branch pipes 3, 4, 5 and 6 so as to measure the temperature of the intake air. An ECU (controller) 20 receives a signal from the O2 sensor 18 and the temperature sensor 19 so as to control the opening and closure of each of the exhaust gas re-circulating valves 17. In addition to the signal from the O2 sensor 18 and the temperature sensor 19, the ECU 20 is supplied with data including clearance of a throttle lever from a base position, the revolution of the engine and the temperature of the engine cooling water.

A description will now be given of the operation of the prior-art gas re-circulating apparatus.

When the engine 1 is being operated, the control signal from the ECU 20 causes the exhaust gas re-circulating valve 17 to open so that a portion of the exhaust gas flowing in the exhaust pipe 11 of the exhaust manifold 1B is mixed with the intake air in the branch pipes 3, 4, 5 and 6 of the intake manifold 1A via the branch pipes 13, 14, 15 and 16 of the exhaust gas re-circulating passage 12, and returned to the respective cylinder of the engine 1. If the volume of re-circulated air differs from cylinder to cylinder, combustion occurs in the cylinders in different manners. The exhaust gas re-circulating valve 17 is controlled to open slightly or extensively in accordance with the signal from the ECU 20 produced on the basis of the signals from the O2 sensor 18 and the temperature sensor 19, so as to correct the differences in the manner of combustion. Thus, generation of NOX is restrained by controlling the volume of exhaust gas re-circulated to the cylinders of the engine 1.

With the above-described construction of the prior-art exhaust gas re-circulating apparatus, generation of NOX in the exhaust gas is controlled to a certain extent. However, the length of the branch pipes 13, 14, 15 and 16 of the exhaust gas re-circulating pipe 12, that is, the length of the re-circulation path from the exhaust gas re-circulating valve 17 to the respective cylinder of the engine 1 differs from cylinder to cylinder. This causes the volume of exhaust gas re-circulated to the respective cylinder to vary from cylinder to cylinder when the exhaust gas re-circulating valves 17 of the cylinders are similarly opened, thereby producing a variation in combustion performance from cylinder to cylinder. Such a variation is unfavorable in terms of the EGR effect provided as a result. The exhaust gas re-circulating valve 17 is provided at a respective branch of the branch pipes 13, 14, 15 and 16 of the exhaust gas re-circulating passage 12 and is removed from the intake manifold 1A. Thus, the EGR response is relatively poor. In the case of a diesel engine, black smoke may be produced.

SUMMARY OF THE INVENTION

The present invention has been developed in view of the above problems and has an object of providing an exhaust gas re-circulating apparatus in which the aforementioned problems are eliminated.

Another and more specific object of the present invention is to provide an exhaust gas re-circulating apparatus in which the exhaust gas is uniformly re-circulated to cylinders of a multi-cylinder engine so that the combustion occurring in the cylinders is optimized and the EGR precision is improved.

Still another object of the present invention is to provide an exhaust gas re-circulating apparatus in which the EGR response is improved and black smoke is prevented from being produced in a diesel engine.

Yet another object of the present invention is to provide an exhaust gas re-circulating apparatus providing an excellent response and a high EGR precision in which re-circulated exhaust gas is directly introduced into a combustion chamber of each cylinder of an engine so that it is ensured that exhaust gas is uniformly re-circulated to the combustion chambers of the respective cylinders so that combustion occurs in the cylinders in an uniform manner.

Yet another object of the present invention is to provide an exhaust gas re-circulating apparatus in which the distance from an exhaust gas re-circulating valve at a re-circulated exhaust gas intake port to a respective cylinder is identical for all cylinders, the layout of branch pipes of an exhaust gas re-circulating passage may be designed in a desirable manner, and the exhaust gas is uniformly re-circulated to the cylinders.

The aforementioned objects can be achieved by an exhaust gas re-circulating apparatus comprising: an exhaust gas re-circulating passage communicating with an exhaust system and an intake system of an engine provided with a plurality of cylinders and returning a portion of exhaust gas of the engine to the cylinders; and a plurality of exhaust gas re-circulating valves provided in the exhaust gas re-circulating passage, each of the plurality of exhaust gas re-circulating valves controlling a volume of exhaust gas returned to a respective one of the cylinders, wherein each of the plurality of exhaust gas re-circulating valves is provided at an identical distance from a respective one of the cylinders.

Each of the plurality of exhaust gas re-circulating valves may be provided in a re-circulated exhaust gas intake port for a respective one of the cylinders, the re-circulated exhaust gas intake port being provided in an intake manifold of the engine.

Each of the plurality of exhaust gas re-circulating valves may be provided in a re-circulated exhaust gas intake port provided in a combustion chamber of each of the cylinders of the engine.

A branch pipe may branch off of the exhaust gas re-circulating passage and distributes re-circulated exhaust gas to a respective one of the cylinders.

A branch pipe branching off of the exhaust gas re-circulating passage and distributing re-circulated exhaust gas to a respective one of the cylinders may be connected to the re-circulated exhaust gas intake port.

BRIEF DESCRIPTION OF THE DRAWINGS

Other objects and further features of the present invention will be apparent from the following detailed description and the drawings in which.

DETAILED DESCRIPTION OF THE PREFERRED EMBODIMENTS

A description will now be given of a first embodiment of the present invention.

Figure 1:
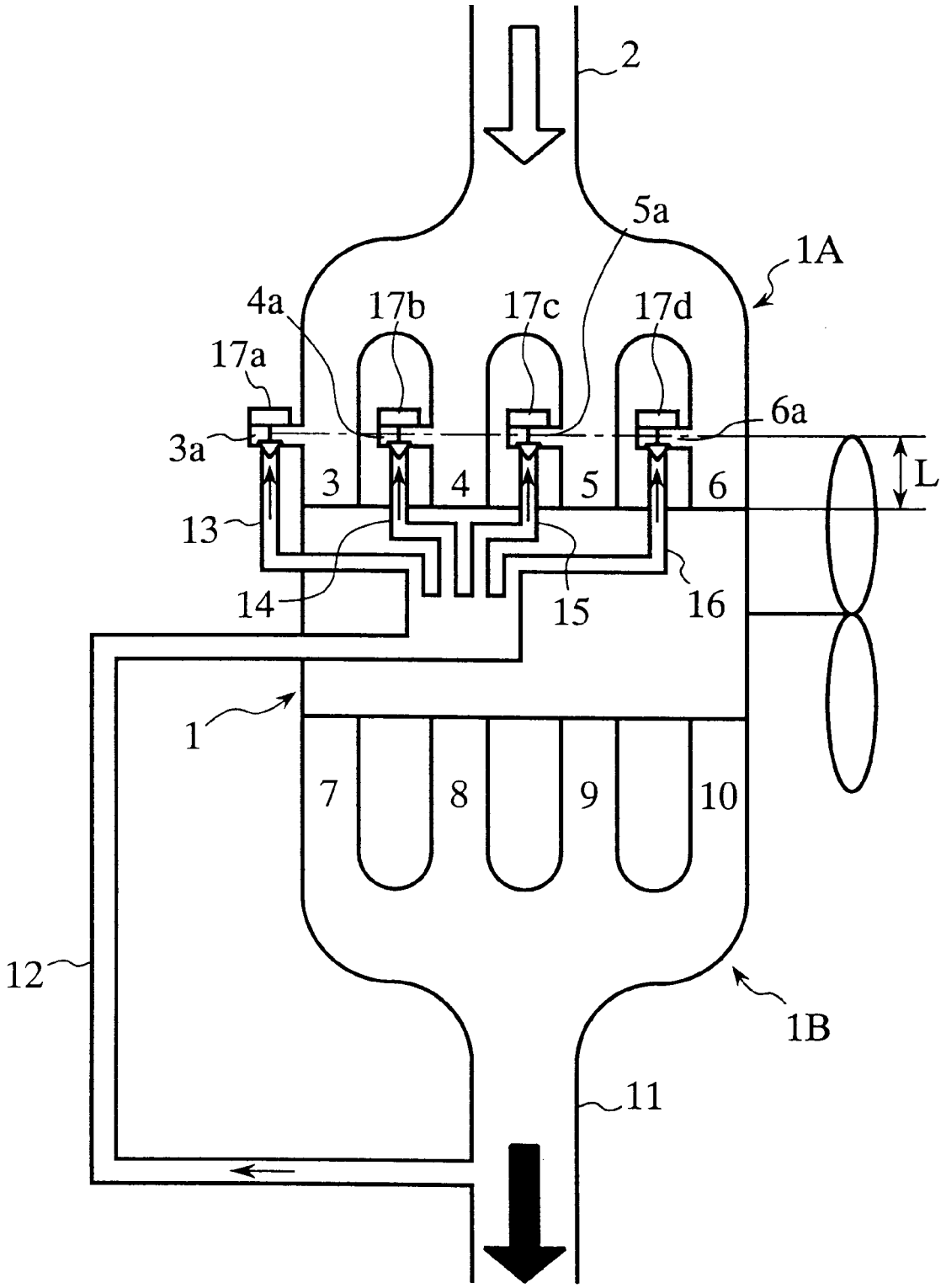
FIG. 1 is a schematic diagram showing an exhaust gas re-circulating apparatus according to a first embodiment of the present invention.
Figure 3:
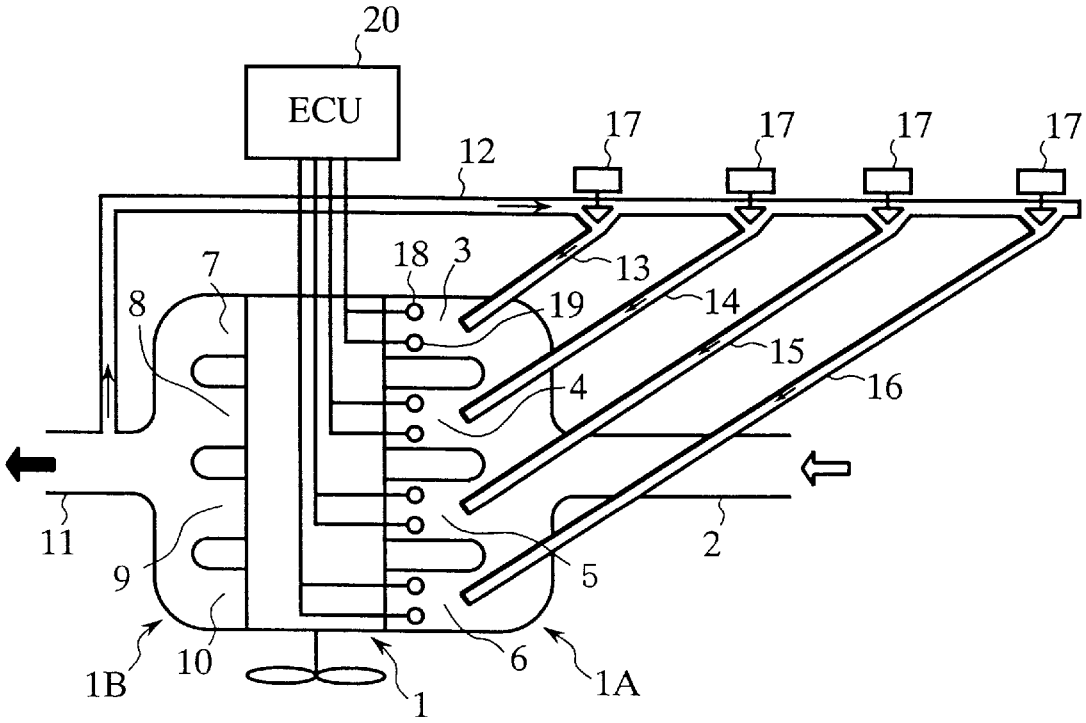
FIG.3 (PRIOR ART)
FIG. 3 is a schematic diagram showing an exhaust gas re-circulating apparatus according to the prior art.

FIG. 1 is a schematic diagram showing an exhaust gas re-circulating apparatus according to a first embodiment of the present invention. In FIG. 1, those components corresponding to the components of FIG. 3 are designated by the same reference numerals and the description thereof is omitted. Referring to FIG. 1, re-circulated exhaust gas intake ports 3*a*, 4*a*, 5*a* and 6*a* are provided in the intake branch pipes 3, 4, 5 and 6 of the intake manifold 1A, respectively. The re-circulated exhaust gas intake ports 3*a*, 4*a*, 5*a* and 6*a* are formed to have the same diameter and removed from the respective cylinders (not shown) of the engine by the same distance. The branch pipes 13, 14, 15 and 16 are connected to the re-circulated exhaust gas intake ports 3*a*, 4*a*, 5*a* and 6*a*, respectively.

Exhaust gas re-circulating valves 17*a*, 17*b*, 17*c* and 17*d* are provided at the re-circulated exhaust gas intake ports 3*a*, 4*a*, 5*a* and 6*a*, respectively. The exhaust gas re-circulating valves 17*a*, 17*b*, 17*c* and 17*d* are removed by the same distance L from the respective cylinders of the engine 1 since the re-circulated exhaust gas intake ports 3*a*, 4*a*, 5*a* and 6*a* at which the exhaust gas re-circulating valves 17*a*, 17*b*, 17*c* and 17*d* are provided are removed from the engine 1 by the same distance. Moreover, the exhaust gas re-circulating valves 17*a*, 17*b*, 17*c* and 17*d* are close to respective combustion chambers. For this reason, the volume of exhaust gas re-circulated to each of the cylinders can be controlled with an efficient response.

A description will now be given of the operation of the exhaust gas re-circulating apparatus of the present invention.

When the engine 1 is being operated, the exhaust gas re-circulating valves 17*a*, 17*b*, 17*c* and 17*d* are simultaneously opened to produce a clearance from the closed position commensurate with the operating condition. As a result of this, the re-circulated exhaust gas from the branch pipes 13, 14, 15 and 16 of the exhaust gas re-circulating passage 12 flows into the intake branch pipes 3, 4, 5 and 6, respectively, via the re-circulated exhaust gas intake ports 3*a*, 4*a*, 5*a* and 6*a* of the intake manifold 1A so as to be mixed with the intake air and distributed to the cylinders of the engine 1. By ensuring that the exhaust gas re-circulating valves 17*a*, 17*b*, 17*c* and 17*d* are removed from the respective cylinders of the engine 1 by the same distance L, it is ensured that the exhaust gas is uniformly re-circulated to the respective cylinders of the engine 1. This can be achieved by controlling the exhaust gas re-circulating valves 17*a*, 17*b*, 17*c* and 17*d* to open to produce the same clearance from the closed position. The exhaust gas re-circulating valves 17*a*, 17*b*, 17*c* and 17*d* may be individually controlled so as to obtain optimum EGR performance in the cylinders of the engine 1. A delay in the flowing of the exhaust gas into an engine combustion chamber is prevented according to the present invention. With this, a variation in combustion performance from cylinder to cylinder is prevented.

According to the first embodiment as described above, by providing the exhaust gas re-circulating valves 17*a*, 17*b*, 17*c* and 17*d* at the same distance from the respective cylinders of the engine 1, the exhaust gas is uniformly re-circulated to the cylinders. Thus, a variation in combustion performance from cylinder to cylinder is prevented so that the combustion in the cylinders is optimized and the EGR precision is improved. By providing the exhaust gas re-circulating valves 17*a*, 17*b*, 17*c* and 17*d* at the intake branch pipes 3, 4, 5 and 6 of the intake manifold 1, the distance L from the exhaust gas re-circulating valves 17*a*, 17*b*, 17*c* and 17*d* to the respective cylinders of the engine 1 is reduced. Due to the reduction in the distance, the EGR response is improved, the EGR prevision is improved and production of black smoke is prevented in a diesel engine.

Figure 2:
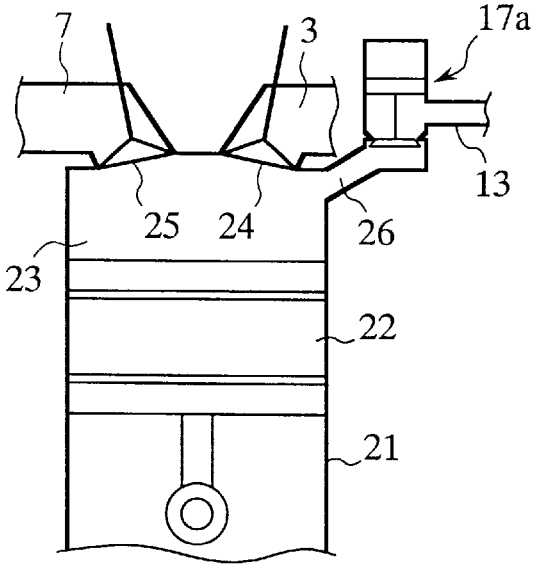
FIG. 2 is a partial schematic diagram showing an exhaust gas re-circulating apparatus according to a second embodiment of the present invention.

FIG. 2 is a partial schematic diagram of an exhaust gas re-circulating apparatus according to a second embodiment of the present invention.

In FIG. 2, those components corresponding to the components of FIG. 1 and FIG. 3 are designated by the same reference numerals and the description thereof is omitted. Referring to FIG. 2, numeral 21 indicates a cylinder in the multi-cylinder engine 1, 22 indicates a piston performing a reciprocal movement in the cylinder 21, 23 indicates a combustion chamber formed in the cylinder 21, 24 indicates an intake valve, 25 indicates an exhaust valve, 26 indicates an re-circulated exhaust gas intake port provided adjacent to the combustion chamber 23. The exhaust gas re-circulating valve 17*a* is provided at the re-circulated exhaust gas intake port 26. The branch pipe 13 branching off of the exhaust gas re-circulating passage 12 shown in FIG. 1 is connected to the re-circulated exhaust gas intake port 26 via the exhaust gas re-circulating valve 17*a*.

In the second embodiment, opening of the exhaust gas re-circulating valve 17*a* is timed to occur in synchronization with the opening of the intake valve 24. The exhaust gas re-circulating valve 17*a* is opened in a direction in which the pressure in the combustion chamber 23 is exerted on the exhaust gas re-circulating valve 17*a* so as to ensure that the valve 17*a* is properly closed.

The description above with reference to FIG. 2 highlights one of a plurality of cylinders, wherein the re-circulated exhaust gas intake port 26 is provided in the combustion chamber 23 and the exhaust gas re-circulating valve 17*a* is provided at the exhaust gas circulating intake port 26. In actual implementation of the second embodiment, the re-circulated exhaust gas intake port 26 is provided in the combustion chamber of each of the cylinders of the multi-cylinder engine 1 of FIG. 1. Each of the exhaust gas re-circulating valves 17*a*, 17*b*, 17*c* and 17*d* of FIG. 1 is provided at the respective re-circulated exhaust gas intake port 26, and each of the branch pipes 13, 14, 15 and 16 of FIG. 1 is connected to the respective re-circulated exhaust gas intake port 26 via the exhaust gas re-circulating valves 17*a*, 17*b*, 17*c* and 17*d*, respectively.

The exhaust gas re-circulating apparatus according to the second embodiment is constructed such that the distance L (from each of the exhaust gas re-circulating valves 17*a*, 17*b*, 17*c* and 17*d* to the respective cylinder of the multi-cylinder engine 1) is minimized by providing, as shown in FIG. 2, the re-circulated exhaust gas intake port 26 adjacent to the combustion chamber 23 of each of the cylinder 21 of the multi-cylinder engine 1, and by providing each of the exhaust gas re-circulating valves 17*a*, 17*b*, 17*c* and 17*d* at the respective re-circulated exhaust gas intake port 26.

According to the second embodiment, the effect provided by the first embodiment is enhanced. Moreover, the apparatus according to the second embodiment is suitable for engines requiring a high-level combustion control such as an gasoline injection engine or a diesel direct-injection engine.

As described above, each of a plurality of exhaust gas re-circulating valves is provided in a respective exhaust gas re-circulating passage that communicates with an exhaust system and an intake system of an engine provided with a plurality of cylinders such that the distance between the exhaust gas re-circulating valve and the respective cylinder is identical for all cylinders. Accordingly, the exhaust gas is uniformly re-circulated to each of the cylinders when the exhaust gas re-circulating valves are controlled to open to produce the same clearance from the closed position. The advantages provided by such a construction include prevention of a variation in combustion performance from cylinder to cylinder, optimization of combustion in the cylinders, and improvement in EGR precision.

By providing re-circulated exhaust gas intake ports for respective cylinders in an intake manifold of an engine, and by providing an exhaust gas re-circulating valve in each of the re-circulated exhaust gas intake ports, the distance between the exhaust gas re-circulating valve and the respective cylinder is reduced. Thus, the EGR response is improved, the EGR precision is improved, and black smoke is prevented from being produced in a diesel engine.

In further accordance with the invention, by providing the re-circulated exhaust gas intake port in a combustion chamber of each of cylinders of an engine and by providing the exhaust gas re-circulating valve in the respective re-circulated exhaust gas intake port, the distance from the exhaust gas re-circulating valve to the respective cylinder is reduced. This results in an exhaust gas re-circulating apparatus in which a variation in combustion performance from cylinder to cylinder is prevented, the EGR response is improved, and the EGR precision is improved.

In further accordance with the invention, by connecting the branch pipe of the exhaust gas re-circulating passage to the re-circulated exhaust gas intake port, the distance from the exhaust gas re-circulating valve at the re-circulated exhaust gas intake port to the respective cylinder is identical for all cylinders irrespective of the length of the branch pipes of the exhaust gas re-circulating passage. With this, the layout of the branch pipes of the exhaust gas re-circulating passage may be designed in a desirable manner so that the exhaust gas is uniformly re-circulated to the cylinders.

What is claimed is:

1. An exhaust gas re-circulating apparatus comprising:

an exhaust gas re-circulating passage communicating with an exhaust manifold and an intake system of an engine provided with a plurality of cylinders, for returning a portion of exhaust gas of the engine to the cylinders; and a plurality of discrete, electrically actuated exhaust gas re-circulating valves provided in said exhaust gas re-circulating passage, each of said plurality of exhaust gas re-circulating valves independently and variably controlling a volume of exhaust gas returned directly into an associated one of the cylinders, wherein each of said plurality of exhaust gas re-circulating valves is disposed at an identical distance from an associated one of the cylinders.

2. The exhaust gas re-circulating apparatus according to claim 1, wherein each of said plurality of exhaust gas re-circulating valves is disposed in a re-circulated exhaust gas intake port (26) provided in a combustion chamber (28) of each of the cylinders of the engine.

3. The exhaust gas re-circulating apparatus according to claim 2, wherein a branch pipe branches off of said exhaust gas re-circulating passage and distributes re-circulated exhaust gas to a respective one of the cylinders.

* * * * *